US011809143B2

(12) United States Patent
Yasuda

(10) Patent No.: US 11,809,143 B2
(45) **Date of Patent: *Nov. 7, 2023**

(54) PUSH BUTTON DEVICE AND TIMEPIECE

(71) Applicant: CASIO COMPUTER CO., LTD., Tokyo (JP)

(72) Inventor: Takumi Yasuda, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 17/469,197

(22) Filed: Sep. 8, 2021

(65) Prior Publication Data

US 2021/0405593 A1 Dec. 30, 2021

Related U.S. Application Data

(63) Continuation of application No. 16/589,354, filed on Oct. 1, 2019, now Pat. No. 11,150,610.

(30) Foreign Application Priority Data

Oct. 4, 2018 (JP) ..... 2018-189355

(51) Int. Cl.
*G04G 17/08* (2006.01)
*G04G 21/00* (2010.01)

(52) U.S. Cl.
CPC ..... *G04G 17/08* (2013.01); *G04G 21/00* (2013.01)

(58) Field of Classification Search
CPC .... G04G 617/08; G04G 21/00; G04B 37/088; G04B 37/02; G04B 37/10; G04B 37/103;
(Continued)

(56) References Cited

U.S. PATENT DOCUMENTS 4,007,347 A * 2/1977 Haber ..... G04C 3/005 200/530
4,364,674 A * 12/1982 Tesch ..... G04B 37/106 368/308

(Continued)

FOREIGN PATENT DOCUMENTS

JP 2007-256067 A 10/2007

OTHER PUBLICATIONS

Notice of Allowance dated Jul. 8, 2021 received in U.S. Appl. No. 16/589,354.

*Primary Examiner* — Edwin A. Leon
(74) *Attorney, Agent, or Firm* — SCULLY SCOTT MURPHY & PRESSER, PC

(57) ABSTRACT

A push button device including a supporting member which is provided with a through hole and in which a recess section is provided outside the through hole, an operation member which includes a shaft section that is slidably inserted into the through hole, and a head section that is provided on an outer end of the shaft section and slidably fitted into the recess section, a first filter which is provided in the recess section and arranged at a position surrounded by an annular first groove section into which an outer circumferential convex section of the head section is fitted and the outer circumferential convex section, and a second filter which is provided in the head section and arranged at a position surrounded by an annular second groove section into which an inner circumferential convex section of the recess section is fitted and the inner circumferential convex section.

20 Claims, 5 Drawing Sheets

(58) Field of Classification Search
CPC .. G04B 37/106; G04B 37/08; H01H 2221/08; H01H 2300/016; H01H 13/14; H01H 13/06
See application file for complete search history.

(56) References Cited

U.S. PATENT DOCUMENTS

| | | | | |
|---|---|---|---|---|
| 5,631,881 | A * | 5/1997 | Pessey | G04C 3/001 368/290 |
| 9,336,967 | B2 | 5/2016 | Sakurazawa et al. | |
| 10,152,024 | B2 | 12/2018 | Baebler et al. | |
| 10,627,781 | B2 | 4/2020 | Ichimura et al. | |
| 10,871,747 | B2 | 12/2020 | Baebler et al. | |
| 10,908,557 | B2 | 2/2021 | Podvin et al. | |
| 10,928,780 | B2 | 2/2021 | Loetscher | |
| 11,150,610 | B2 * | 10/2021 | Yasuda | G04C 3/001 |
| 11,181,867 | B2 * | 11/2021 | Hitsumoto | G04B 3/048 |
| 2003/0174590 | A1 * | 9/2003 | Arikawa | G04B 37/106 368/319 |

* cited by examiner

PUSH BUTTON DEVICE AND TIMEPIECE

CROSS-REFERENCE TO RELATED APPLICATION

This application is a continuation application of U.S. patent application Ser. No. 16/589,354 filed on Oct. 1, 2019 and based upon and claims the benefit of priority from the prior Japanese Patent Application No. 2018-189355, filed Oct. 4, 2018, the entire contents of which are incorporated herein by reference.

BACKGROUND

1. Technical Field

The present invention relates to a push button device and a timepiece equipped with the push button device.

2. Description of the Related Art

For example, a push button device for a wristwatch is known which has a structure where a cylindrical member is provided in a through hole in a wristwatch case, a shaft section of an operation member is inserted into the cylindrical member, a head section of the operation member is projected outside the wristwatch case, and a switch element in the wristwatch case performs a switching operation by the projected head being depressed, as shown in Japanese Patent Application Laid-Open (Kokai) Publication No. 2007-256067. In the structure of this pushbutton device, a recess section for accommodating the head section of the operation member is provided on the outer surface side of the wristwatch case, a coil spring is arranged in the recess section, and the head section of the operation member is pressed toward the outside of the wristwatch case by the spring force of the coil spring. Also, in the structure of this push button device, a plurality of waterproof members is provided on the outer circumference of the shaft section of the operation member, and the shaft section is slid with them being in pressure contact with the inner circumference surface of the cylindrical member. However, in this push button device, when foreign substances such as mud or sand intrude into the recess section of the wristwatch case from a space between the inner circumference surface of the recess section of the wristwatch case and the outer circumference surface of the head section of the operation member, the resilient deformation of the coil spring is affected by these foreign substances, whereby the operability of the operation member is deteriorated.

SUMMARY

In accordance with one embodiment, there is provided a push button device comprising: a supporting member which is provided with a through hole and in which a recess section is provided outside the through hole; an operation member which includes a shaft section that is slidably inserted into the through hole, and a head section that is provided on an outer end of the shaft section and slidably fitted into the recess section; a first filter which is provided in the recess section and arranged at a position surrounded by an annular first groove section into which an outer circumferential convex section of the head section is fitted and the outer circumferential convex section of the head section; and a second filter which is provided in the head section and arranged at a position surrounded by an annular second groove section into which an inner circumferential convex section of the recess section positioned at an inner circumference of the first groove section is fitted and the inner circumferential convex section of the recess section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied in a wristwatch will hereinafter be described with reference to FIG. 1 to FIG. 5.

Figure 1:
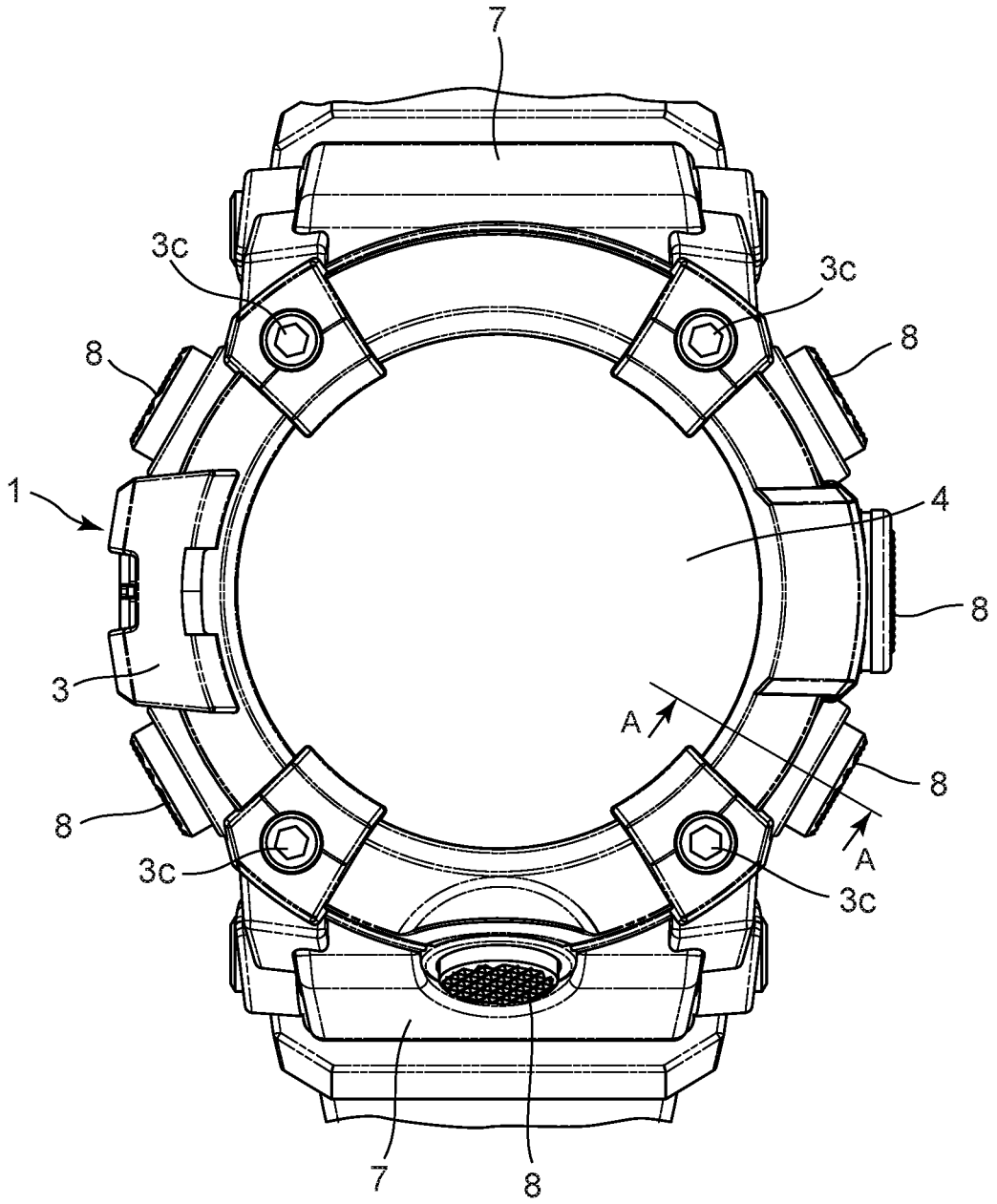
FIG. 1 is an enlarged front view of an embodiment.
Figure 2:
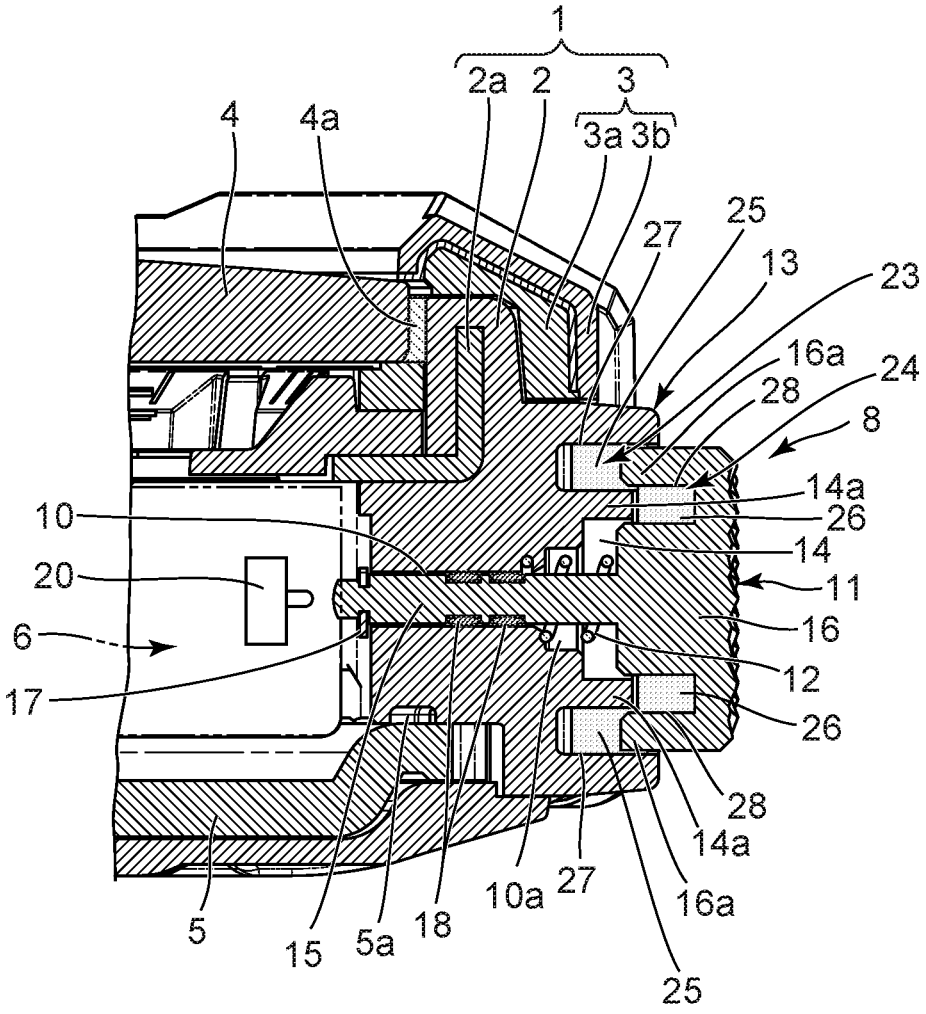
FIG. 2 is an enlarged sectional view of a main portion of the wristwatch taken along line A-A in FIG. 1.
Figure 3:
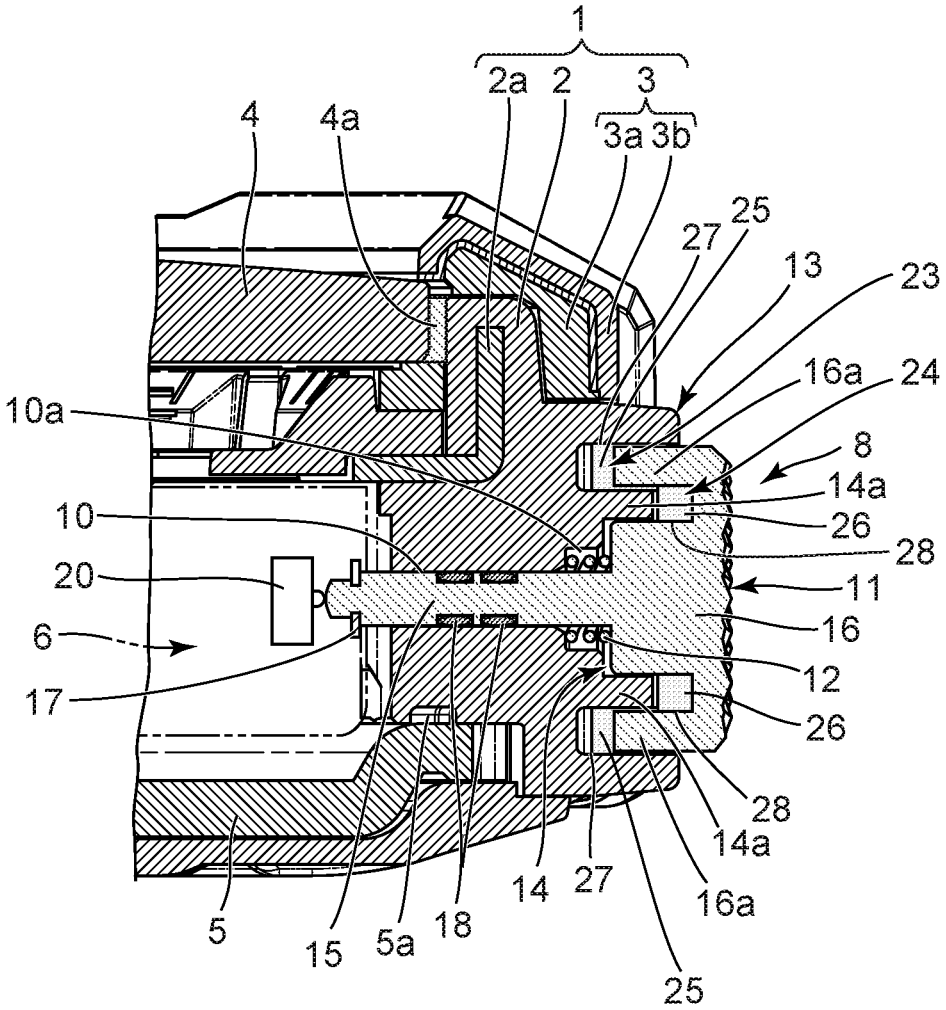
FIG. 3 is an enlarged sectional view where an operation member of a push button device shown in FIG. 2 has been depressed toward the inside of the wristwatch case.

This wristwatch has a wristwatch case 1 as shown in FIG. 1 to FIG. 3, and the wristwatch case 1 includes a main body case 2 and an exterior case 3.

The main body case 2 is formed of hard synthetic resin, and has metal reinforcement sections 2*a* embedded therein, as shown in FIG. 1 to FIG. 3. The exterior case 3 includes a first exterior member 3*a* formed of soft synthetic resin such as urethane resin and a second exterior member 3*b* formed of metal such as stainless steel. The first exterior member 3*a* and the second exterior member 3*b* are attached to the main body case 2 by screws 3*c* with them covering outer circumference portions of the main body case 2.

To the upper opening of the wristwatch case 1, that is, to the upper opening of the main body case 2, a watch glass 4 is attached via a glass packing 4*a*, as shown in FIG. 1 to FIG. 3. Also, to the bottom of the wristwatch case 1, that is, to the bottom of the main body case 2, a back cover 5 is attached via a waterproof ring 5*a*.

Inside the wristwatch case 1, that is, inside the main body case 2, a timepiece module 6 is arranged, as shown in FIG. 2 and FIG. 3. This timepiece module 6 has various components which are not shown in the drawings but are necessary for timepiece functions, such as a timepiece movement for driving pointers to indicate the time, a display section for displaying information including time information, a switch element 20 described later, and a circuit section for electrically driving and controlling these sections.

On side portions on the twelve o'clock side and six o'clock side of the wristwatch case 1, band attachment sections 7 where a watch band (not shown) is attached are provided, as shown in FIG. 1. Also, on side portions on the two o'clock side, three o'clock side, four o'clock side, six o'clock side, eight o'clock side, and ten o'clock side of the wristwatch case 1, push button devices 8 are provided, respectively.

Among these plurality of push button devices 8, for example, the push button device 8 located on the four o'clock side includes an operation member 11 slidably inserted into a through hole 10 provided in the main body case 2 of the wristwatch case 1 which is a supporting member, and a spring member 12 which forces the operation member 11 toward the outside of the wristwatch case 1, as shown in FIG. 2 and FIG. 3.

On the outer end of the through hole 10 of the main body case 2, a counterbore section 10*a* whose inner diameter is slightly longer than that of the through hole 10 is formed, as shown in FIG. 2 and FIG. 3. Also, on an outer circumference portion of the main body case 2, a cylindrical section 13 whose inner diameter is sufficiently longer than that of the through hole 10 is provided coaxially with the through hole 10.

This cylindrical section 13 is formed such that its outer diameter is longer than the thickness of the timepiece module 6 in the main body case 2, that is, the length of the timepiece module 6 in the vertical direction, and is shorter than the length between the undersurface of the watch glass 4 and the undersurface of the back cover 5, as shown in FIG. 2 and FIG. 3. The inner diameter of this cylindrical section 13 is slightly longer than the thickness of the timepiece module 6 in the main body case 2, that is, the length of the timepiece module 6 in the vertical direction. In this cylindrical section 13, a recess section 14 is provided.

The operation member 11 includes a shaft section 15 that is slidably and rotatably inserted into the through hole 10 of the main body case 2, and a head section 16 that is provided on the outer end of the shaft section 15 and slidably and rotatably arranged in the recess section 14 of the cylindrical section 13, as shown in FIG. 2 and FIG. 3.

This shaft section 15 of the operation member 11 is formed of metal such as stainless steel and titanium or hard synthetic resin in a round stick shape, and its outer diameter is substantially equal to the inner diameter of the through hole 10 of the main body case 2, as shown in FIG. 2 and FIG. 3. The length of the shaft section 15 in the axial direction is longer than the length of the through hole 10 in the axial direction and shorter than the sum of the length of the through hole 10 and the length of the cylindrical section 13 in the axial direction.

Accordingly, when the shaft section 15 of the operation member 11 is in the through hole 10 of the main body case 2, its outer end protrudes inside the recess section 14 of the cylindrical section 13, and its inner end protrudes inside the main body case 2, as shown in FIG. 2 and FIG. 3. To this protruding inner end, a stopper member 17 such as an E-ring is attached. That is, by the stopper member 17 coming in contact with the inner circumference surface of the main body case 2, the shaft section 15 is prevented from slipping from the through hole 10 toward the outside of the wristwatch case 1.

Also, on the outer circumference surface of the shaft section 15 of the operation member 11, a plurality of packing members 18 are provided, as shown in FIG. 2 and FIG. 3. These packing members 18 achieve waterproofing between the outer circumference surface of the shaft section 15 and the inner circumference surface of the through hole 10 by their outer circumference portions slidably coming in pressure contact with the inner circumference surface of the through hole 10.

The head section 16 of the operation member 11 is made of metal such as stainless steel and titanium or hard synthetic resin as with the shaft section 15, and has a cylindrical shape, as shown in FIG. 2 and FIG. 3. On the center of the inner surface of the head section 16, the outer end of the shaft section 15 is integrally provided. This head section 16 is formed such that its outer diameter is substantially equal to the inner diameter of the cylindrical section 13 and its length in the axial direction is substantially equal to the axial direction length of the recess section 14 in the cylindrical section 13. That is, the head section 16 is structured to be retractably arranged in the recess section 14 of the cylindrical section 13.

The spring member 12 is a coil spring, and is structured to force the head section 16 of the operation member 11 toward the outside of the wristwatch case 1, as shown in FIG. 2 and FIG. 3. That is, this spring member 12 is structured such that its inner end is arranged in the counterbore section 10*a* of the through hole 10 and its outer end comes in resilient contact with the inner surface of the head section 16 of the operation member 11 with this spring member 12 being arranged around the outer circumference of a portion of the shaft section 15 in the recess section 14 of the cylindrical section 13 in the axial direction.

As a result, this spring member 12 is structured such that the head section 16 of the operation member 11 is forced toward the outside of the wristwatch case 1 by its spring force so as to separate the inner end of the shaft section 15 from the switch element 20 of the timepiece module 6 and turn off the switch element 20, and the stopper member 17 on an inner end portion of the shaft section 15 comes in contact with the inner circumference surface of the main body case 2, as shown in FIG. 2 and FIG. 3.

Also, this spring member 12 is structured such that it allows the shaft section 15 to be slid in the axial direction when the head section 16 of the operation member 11 is pressed against the spring force, whereby the switch element 20 of the timepiece module 6 enters an ON state by the inner end of the shaft section 15 protruding in the main body case 2, as shown in FIG. 2 and FIG. 3.

The switch element 20 is structured such that, when the head section 16 is pressed against the spring force of the spring member 12 and the shaft section 15 of the operation member 11 is slid toward the inside of the main body case 2, this switch element 20 is pressed by the inner end of the shaft section 15 pressed into the inside of the main body case 2, and thereby outputs a switch signal by entering the ON state, as shown in FIG. 2 and FIG. 3.

Between the recess section 14 in the cylindrical section 13 and the head sections 16 of the operation member 11, a first space section 23 and a second space section 24 are formed. In FIG. 2 and FIG. 3, a state has been shown in which a first filter 25 has been arranged in the first space section 23 and a second filter 26 has been arranged in the second space section 24.

The first filter 25 and the second filter 26 are made of porous material including a number of air bubbles, and have sponge-like structures that are deformed and restored by the slide movement of the head section 16 of the operation member 11. Note that the above-described air bubbles of the porous material may be connected air bubbles or may be partially connected air bubbles.

The first space section 23 is a space surrounded by an annular first groove section 27 into which an outer circumferential convex section 16*a* of the head section 16 of the operation member 11 is slidably fitted and this outer circumferential convex section 16*a* of the head section 16. In the present embodiment, this first space section 23 is an unclosed space connected to other spaces. However, the present invention is not limited thereto and it may be a (independent) space closed by the first groove section 27 and the outer circumferential convex section 16*a* of the head section 16.

That is, in order to form the first space section 23, the first groove section 27 is formed in a circular ring shape by the outer circumference surface of an inner circumferential convex section 14*a* having an annular shape and provided in the recess section 14 of the cylindrical section 13 and the inner circumference surface of the cylindrical section 13, as shown in FIG. 2 to FIG. 5. As a result, the first groove section 27 is structured such that the outer circumferential convex section 16*a* of the head section 16 of the operation member 11 is slidably fitted into the inside of the first groove section 27 in the axial direction.

Also, the second space section 24 is a space surrounded by an annular second groove section 28 into which the inner circumferential convex section 14*a* of the recess section 14 for forming the first space section 23 is slidably fitted and this inner circumferential convex section 14*a* of the recess section 14. In the present embodiment, this second space section 24 is an unclosed space connected to other spaces. However, the present invention is not limited thereto and it may be a (independent) space closed by the second groove section 28 and the inner circumferential convex section 14*a* in the recess section 14.

That is, in order to form the second space section 24, the second groove section 28 is formed in a circular ring shape having a mean diameter shorter than that of the first groove section 27, by the inner circumference surface of the outer circumferential convex section 16*a* of the head section 16 and a portion of the inner surface of the head section 16 corresponding to the inner circumference surface of the inner circumferential convex section 14*a* of the recess section 14, as shown in FIG. 2 to FIG. 5. As a result, the second groove section 28 is structured such that the inner circumferential convex section 14*a* in the recess section 14 of the cylindrical section 13 is slidably fitted into the inside of the second groove section 28 in the axial direction.

Here, the size of the cross-sectional shape of the first groove section 27 and that of the second groove section 28 are different from each other, as shown in FIG. 2 to FIG. 5. That is, the first groove section 27 is formed such that its groove width, which is the length in the radial direction, is longer than that of the second groove section 28 and its cross-sectional area is larger than that of the second groove section 28.

Figure 4:
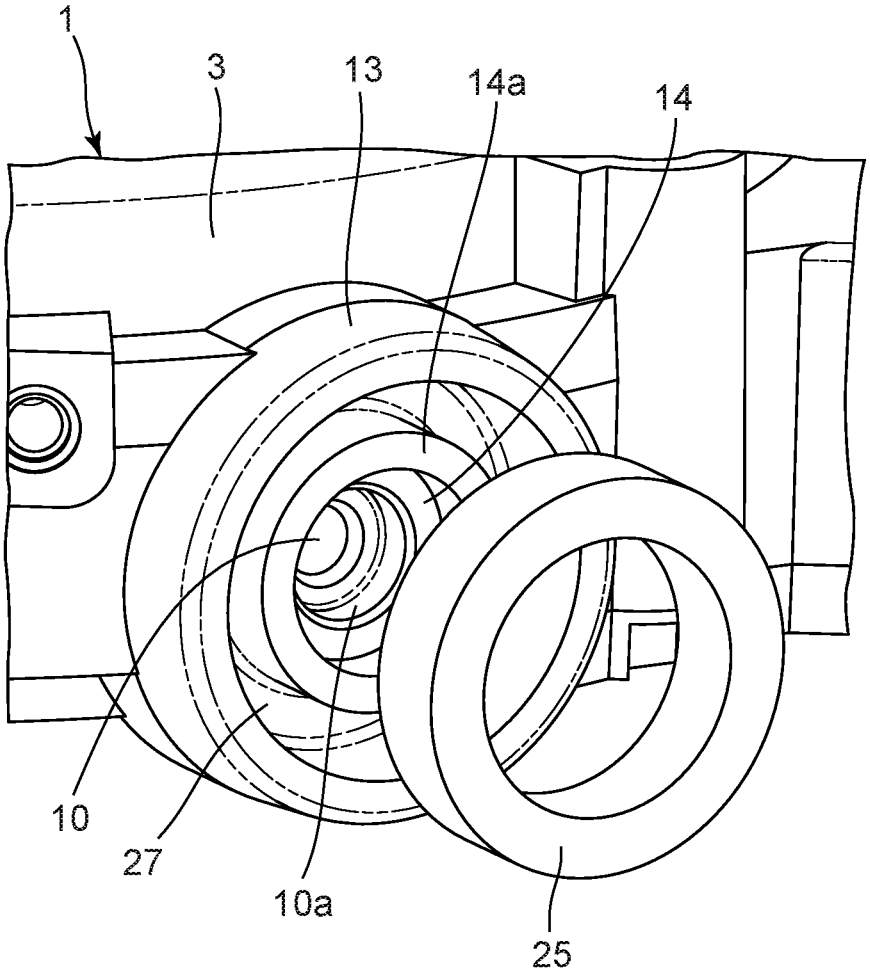
FIG. 4 is an enlarged perspective view where a first space section of the push button device shown in FIG. 2 and a first filter arranged therein have been separated from each other.

The first filter 25 is formed in a ring shape so as to be arranged in the first space section 23 in the first groove section 27, as shown in FIG. 2 to FIG. 4. That is, this first filter 25 is formed such that its outer diameter is equal to the outer diameter of the groove of the first groove section 27 and its inner diameter is equal to the inner diameter of the groove of the first groove section 27. Also, this first filter 25 is formed such that its length (thickness) in the axial direction is substantially equal to the depth of the first groove section 27 in the axial direction.

As a result, the first filter 25 has a shape by which, when the head section 16 of the operation member 11 is depressed from outside the wristwatch case 1 and the operation member 11 is slid toward the inside of the wristwatch case 1, this first filter 25 is depressed by the outer circumferential convex section 16*a* of the head section 16 and thereby deformed to be contracted, as shown in FIG. 2 to FIG. 4.

Also, the first filter 25 is structured such that, when the operation member 11 is slid toward the outside of the wristwatch case 1 by the spring power of the spring member 12, this first filter 25 is swollen and restored back to its original shape along with the slide movement of the outer circumferential convex section 16*a* of the head section 16, that is, the movement of the outer circumferential convex section 16*a* of the head section 16 in the direction to be pulled out of the first groove section 27, as shown in FIG. 2 to FIG. 4.

Figure 5:
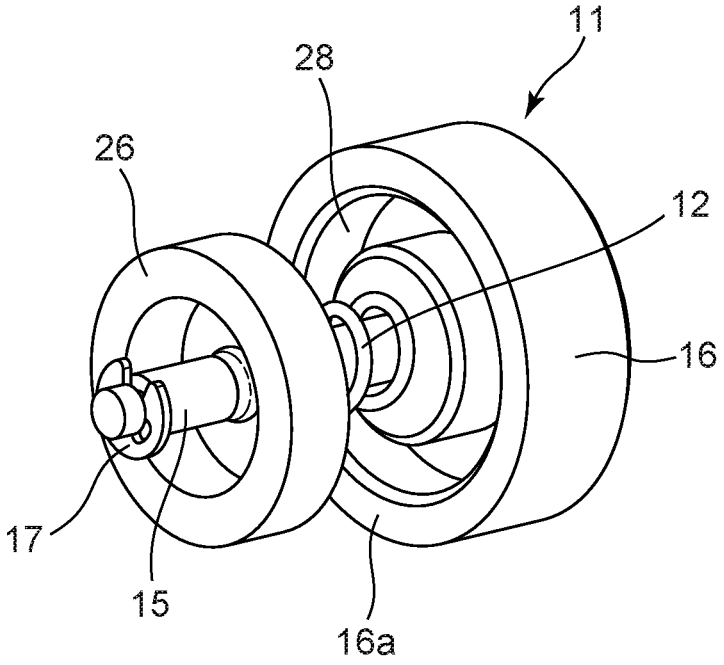
FIG. 5 is an enlarged perspective view where a second space section of the push button device shown in FIG. 2 and a second filter arranged therein have been separated from each other.

On the other hand, the second filter 26 is formed in a ring shape so as to be arranged in the second space section 24 in the second groove section 28, as shown in FIG. 2, FIG. 3 and FIG. 5. That is, this second filter 26 is formed such that its outer diameter is equal to the outer diameter of the groove of the second groove section 28 and its inner diameter is equal to the inner diameter of the groove of the second groove section 28. Also, this second filter 26 is formed such that its length (thickness) in the axial direction is substantially equal to the depth of the second groove section 28 in the axial direction.

As a result, the second filter 26 has a shape by which, when the head section 16 of the operation member 11 is depressed from outside the wristwatch case 1 and the operation member 11 is slid toward the inside of the wristwatch case 1, this second filter 26 is depressed by the inner circumferential convex section 14*a* of the recess section 14 which is being fitted into the second groove section 28 along with the slide movement, and thereby deformed to be contracted, as shown in FIG. 2, FIG. 3 and FIG. 5.

Also, the second filter 26 is structured such that, when the operation member 11 is slid toward the outside of the wristwatch case 1 by the spring power of the spring member 12, this second filter 26 is swollen and restored back to its original shape as a result of the inner circumferential convex section 14*a* of the recess section 14 coming out of the second groove section 28 along with the slide movement, as shown in FIG. 2, FIG. 3 and FIG. 5.

The sizes of the cross-sectional shapes of the first and second filters 25 and 26 are different from each other, as shown in FIG. 2 to FIG. 5. That is, the first filter 25 is formed such that its length in the radial direction is longer that of the second filter 26 and its cross-sectional area is larger than that of the second filter 26.

Also, the air permeability of the first filter 25 and that of the second filter 26 are different from each other. More specifically, the first filter 25 includes air bubbles bigger than those of the second filter 26. As a result, the first filter 25 is structured to restrict the passing through of coarse-grained foreign substances among foreign substances such as mud or sand which have intruded into the first space section 23 from outside the wristwatch case 1.

In addition, the second filter 26 is structured to restrict the passing through of fine-grained foreign substances such as mud or sand which have passed through the first filter 25 and intruded into the second space section 24. As a result, the first filter 25 and the second filter 26 are structured to cooperatively prevent the passing through of foreign substances such as mud or sand which intrude into a space formed between the recess section 14 in the cylindrical section 13 and the head section 16, as shown in FIG. 2 to FIG. 5.

Next, the mechanism of the push button device 8 of this wristwatch is described.

In this pushbutton device 8, in the normal state, the head section 16 of the operation member 11 is protruding from the cylindrical section 13 by being pressed toward the outside of the wristwatch case 1 by the spring force of the spring member 12. In this state, the stopper member 17 provided on the inner end portion of the shaft section 15 of the operation member 11 is in contact with the inner circumference surface of the main body case 2 of the wristwatch case 1.

Accordingly, the inner end of the shaft section 15 of the operation member 11 is away from the switch element 20 of the timepiece module 6, so that the switch element 20 is in the OFF state. In this state, waterproofing has been achieved between the outer circumference surface of the shaft section 15 and the inner circumference surface of the through hole 10 in the main body case 2 by the plurality of packing members 18 provided on the outer circumference surface of the shaft section 15.

Also, in this state, the outer circumferential convex section 16*a* of the head section 16 has been arranged at a position where it is out of the first groove section 27 provided in the recess section 14 of the cylindrical section 13, and the first space section 23 surrounded by the first groove section 27 and the outer circumferential convex section 16*a* of the head section 16 has been formed in the recess section 14. Here, the first filter 25 is in its original swollen shape in the first space section 23.

Moreover, in this state, the inner circumferential convex section 14*a* provided in the recess section 14 of the cylindrical section 13 has been arranged at a position where it is out of the second groove section 28 of the head section 16, and the second space section 24 surrounded by the second groove section 28 and the inner circumferential convex section 14*a* in the recess section 14 has been formed in the recess section 14. Here, the second filter 26 is in its original swollen shape in the second space section 24.

In the above-described state, when the head section 16 of the operation member 11 is depressed toward the inside of the wristwatch case 1 against the spring force of the spring member 12, the first filter 25 in the first space section 23 is depressed by the outer circumferential convex section 16*a* of the head section 16 and thereby deformed to be contracted. At the same time, the second filter 26 in the second space section 24 is pressed by the inner circumferential convex section 14*a* in the recess section 14 of the cylindrical section 13 and thereby deformed to be contracted.

In addition, the shaft section 15 of the operation member 11 is pressed into the main body case 2 by being slid inside the through hole 10 of the main body case 2. As a result, the inner end of the shaft section 15 presses the switch element 20 of the timepiece module 6, so that the switch element 20 enters the ON state. In this case as well, since the plurality of packing members 18 provided on the outer circumference of the shaft section 15 is slide with them being in pressure contact with the inner circumference surface of the through hole 10 in the main body case 2, waterproofing between the outer circumference surface of the shaft section 15 and the inner circumference surface of the through hole 10 is maintained.

When the head section 16 of the operation member 11 is pressed toward the outside of the wristwatch case 1 by the spring force of the spring member 12, the first filter 25 in the first space section 23 is deformed to be swollen and restored back to its original shape along with the slide movement of the head section 16. At the same time, the second filter 26 in the second space section 24 is deformed to be swollen and restored back to its original shape along with the slide movement of the head section 16.

When the operation member 11 is being slid as described above, even if foreign substances such as mud or sand intrude into a space formed between the recess section 14 in the cylindrical section 13 and the head section 16, the first filter 25 and the second filter 26 prevent the passing through of the foreign substances.

That is, since the air permeability of the first filter 25 and that of the second filter 26 are different from each other and the sizes of the air bubbles in the first filter 25 are bigger than those in the second filter 26, the passing through of coarse-grained foreign substances among foreign substances such as mud or sand which have intruded into the first space section 23 from outside the wristwatch case 1 can be restricted by the first filter 25, and the passing through of fine-grained foreign substances such as mud or sand which have passed through the first filter 25 and intruded into the second space section 24 can be restricted by the second filter 26

That is, even if foreign substances such as mud or sand intrude into a space formed between the recess section 14 in the cylindrical section 13 and the head section 16, the first filter 25 and the second filter 26 restrict the passing through of these foreign substances. Accordingly, the intrusion of the foreign substances such as mud or sand into the inside of the push button device 8 is unfailingly and favorably prevented.

As described above, the push button device 8 of this wristwatch includes the main body case 2 of the wristwatch case 1 in which the recess section 14 has been provided outside the through hole 10, the operation member 11 which has the shaft section 15 that is slidably inserted into the through hole 10 and the head section 16 that is provided on the outer end of the shaft section 15 and slidably fitted into the recess section 14, the first filter 25 which is provided in the recess section 14 and surrounded by the annular first groove section 27 where the outer circumferential convex section 16*a* of the head section 16 is fitted and the outer circumferential convex section 16*a*, and the second filter 26 which is provided in the head section 16 and surrounded by the annular second groove section 28 where the inner circumferential convex section 14*a* of the recess section 14 positioned at the inner circumference of the first groove section 27 is fitted and the inner circumferential convex section 14*a*. Accordingly, the intrusion of foreign substances into an area around the shaft section 15 of the operation member 11 can be prevented.

That is, in this pushbutton device 8, the passing through of foreign substances such as mud or sand can be restricted by the first filter 25 and the second filter 26, or in other words, the passing through of foreign substances such as mud or sand can be doubly prevented. Accordingly, the intrusion of foreign substances into the area around the shaft section 15 of the operation member 11 inside the push button device can be unfailingly and favorably prevented, whereby deterioration in the operability of the operation member 11 due to foreign substance intrusion can be prevented.

Also, the first filter 25 and the second filter 26, which are deformed along with the movement of the head section 16 and then restored back to their original shapes along with the movement of the head section 16 in the reverse direction, are made of porous material including a number of connected air bubbles, and can restrict the passing through of foreign substances such as mud or sand by these air bubbles. Accordingly, the intrusion of foreign substances into the inside of the push button device 8 can be unfailingly and favorably prevented. In addition, the first filter 25 and the second filter 26 can be unfailingly and favorably deformed and restored back to their original shapes along with slide movements of the head section 16, whereby the operation member 11 can be favorably slid.

Moreover, in this push button device 8, the first filter 25 is arranged in the first space section 23 which is provided in the recess section 14 and surrounded by the annular first groove section 27 where the outer circumferential convex section 16*a* of the head section 16 is inserted and the outer circumferential convex section 16*a* of the head section 16, and the second filter 26 is arranged in the second space section 24 which is provided in the head section 16 and surrounded by the annular second groove section 28 where the inner circumferential convex section 14*a* of the recess section 14 positioned at the inner circumference of the first groove section 27 is inserted and the inner circumferential convex section 14*a* of the recess section 14.

That is, in this push button device 8, the space between the head section 16 and the recess section 14 has been suitably divided into the first space section 23 and the second space section 24, whereby the first filter 25 can be favorably arranged in the first space section 23 and the second filter 26 can be favorably arranged in the second space section 24. Accordingly, the passing through of foreign substances such as mud or sand can be restricted by the first filter 25 in the first space section 23 and the second filter 26 in the second space section 24, so that the passing through of foreign substances such as mud or sand can be doubly prevented. As a result, deterioration in the operability of the operation member 11 due to foreign substance intrusion can be prevented.

Also, the first space section 23 is surrounded by the annular first groove section 27 provided in the recess section 14 and the outer circumferential convex section 16*a* of the head section 16, and the first groove section 27 can be favorably covered by the outer circumferential convex section 16*a* of the head section 16 with the first filter 25 being arranged therein. Accordingly, the first filter 25 can be favorably arranged in the first space section 23.

Moreover, the second space section 24 is surrounded by the annular second groove section 28 provided in the head section 16 and the inner circumferential convex section 14*a* of the recess section 14, and the second groove section 28 can be favorably covered by the inner circumferential convex section 14*a* of the recess section 14 with the second filter 26 being arranged therein. Accordingly, the second filter 26 can be favorably arranged in the second space section 24.

Also, in this push button device 8, the air permeability of the first filter 25 and that of the second filter 26 are different from each other, whereby the structure can be achieved in which the passing state of foreign substances such as mud or sand in the first filter 25 and that in the second filter 26 are different from each other. That is, since the air permeability of the second filter 26 is lower than that of the first filter 25, the passing through of foreign substances can be more greatly restricted in the second filter 26 than the first filter 25.

In this embodiment, the sizes of air bubbles are different between the first filter 25 and the second filter 26, whereby the structure can be achieved in which the sizes of passing foreign substances such as mud or sand are different between the first filter 25 and the second filter 26. That is, the sizes of the air bubbles in the second filter 26 are smaller than those in the first filter 25, whereby the structure can be achieved in which the particle sizes of foreign substances which are restricted when passing through the second filter 26 are smaller than the particle sizes of foreign substances which are restricted when passing through the first filter 25.

Accordingly, in this push button device 8, the passing through of coarse-grained foreign substances among foreign substances such as mud or sand which have intruded into the first space section 23 from outside the wristwatch case 1 can be favorably restricted by the first filter 25. In addition, the passing through of fine-grained foreign substances such as mud or sand which have passed through the first filter 25 and intruded into the second space section 24 can be unfailingly restricted by the second filter 26.

As a result, in this pushbutton device 8, even if foreign substances such as mud or sand intrude into a space formed between the recess section 14 in the cylindrical section 13 and the head section 16 due to the slide movement of the operation section 11, the passing through of these foreign substances can be unfailingly and favorably prevented by the first filter 25 and the second filter 26, so that the intrusion of the foreign substances such as mud or sand into the inside of the push button device 8 can be unfailingly prevented.

In the above-described embodiment, the main body case 2 of the wristwatch case 1 is used as a supporting member, the through hole 10 and the cylindrical section 13 are provided to the main body case 2, the shaft section 15 of the operation member 11 is inserted into the through hole 10, and the head section 16 is arranged in the recess section 14 in the cylindrical section 13. However, the present invention is not limited thereto, and a structure may be adopted in which a cylindrical member that serves as a supporting member is fitted into the through hole 10 of the main body case 2, and the operation member 11 is slidably provided in this cylindrical member.

In that structure, the cylindrical member is required to include a small-diameter cylinder section which is inserted into the through hole 10 of the main body case 2 and in which the shaft section 15 of the operation member 11 is slidably inserted, and a large-diameter cylindrical section which is arranged outside the main body case 2 and has the recess section 14 where the head section 16 of the operation member 11 is slidably accommodated. In this case as well, a space is required to be formed between the head section 16 of the operation member 11 and the recess section 14 of the large-diameter cylindrical section.

Also, in the above-described embodiment, the push button device 8 provided on the four o'clock side of the wristwatch case 1 has been described. However, the present invention is not limited thereto, and can be applied to the push button devices provided on the two o'clock side, the three o'clock side, the six o'clock side, the eight o'clock side, and the ten o'clock side.

Moreover, in the above-described embodiment, the structure has been described in which the wristwatch case 1 includes the main body case 2 and the exterior case 3. However, the present invention is not limited thereto, and a structure may be adopted in which a wristwatch case is constituted only by a main body case.

Furthermore, in the above-described embodiment, the structure where the head of the operation member 11 and the recess section 14 have round shapes has been described as an example. However, the present invention is not limited thereto, and they may have rectangular shapes or oval shapes.

Also, in the above-described embodiment, the present invention has been applied in a wristwatch. However, the present invention is not necessarily required to be applied in a wristwatch. For example, the present invention is applicable to various types of timepieces such as a travel watch, an alarm clock, a table clock, and a wall clock. Moreover, the present invention is not necessarily required to be applied in timepieces, and can be widely applied in electronic devices such as a portable telephone and a portable terminal device.

While the present invention has been described with reference to the preferred embodiments, it is intended that the invention be not limited by any of the details of the description therein but includes all the embodiments which fall within the scope of the appended claims.

What is claimed is:

1. A push button device comprising:

a supporting member which is provided with a through hole; and an operation member which is provided a shaft section that is inserted into the through hole, wherein the operation member has a first convex section which is provided so as to surround the shaft section, wherein the supporting member has a first concave section which is in a ring shape and at a position corresponding to the first convex section, and wherein a first filter is arranged between a bottom portion of the first concave section and a top portion of the first convex section.

2. The push button device according to claim 1, wherein the operation member has a second concave section which is in a ring shape and on an outer circumferential side or an inner circumference side of the position corresponding to the first convex section, wherein the supporting member has a second convex section which is in a ring shape and at a position corresponding to the second concave section, and wherein a second filter is arranged between a bottom portion of the second concave section and a top portion of the second convex section.

3. The push button device according to claim 1, wherein the first concave section is a space closed by the first convex section of the operation member.

4. The push button device according to claim 2, wherein the first concave section is a space closed by the first convex section of the operation member.

5. The push button device according to claim 1, wherein the second concave section is a space closed by the second convex section of the supporting member.

6. The push button device according to claim 2, wherein the second concave section is a space closed by the second convex section of the supporting member.

7. The push button device according to claim 3, wherein the second concave section is a space closed by the second convex section of the supporting member.

8. The push button device according to claim 4, wherein the second concave section is a space closed by the second convex section of the supporting member.

9. A push button device comprising:

a supporting member which is provided with a through hole; and an operation member which is provided a shaft section that is inserted into the through hole, wherein the operation member has a first concave section which is provided so as to surround the shaft section, wherein the supporting member has a first convex section which is in a ring shape and at a position corresponding to the first concave section, and wherein a first filter is arranged between a top portion of the first convex section and a bottom portion of the first concave section.

10. The push button device according to claim 9, wherein the operation member has a second convex section which is in a ring shape and on an outer circumferential side or an inner circumference side of the position corresponding to the first concave section, wherein the supporting member has a second concave section which is in a ring shape and at a position corresponding to the second convex section, and wherein a second filter is arranged between a top portion of the second convex section and a bottom portion of the second concave section.

11. The push button device according to claim 9, wherein the second concave section is a space closed by the second convex section of the operation member.

12. The push button device according to claim 10, wherein the second concave section is a space closed by the second convex section of the operation member.

13. The push button device according to claim 9, wherein the first concave section is a space closed by the first convex section of the supporting member.

14. The push button device according to claim 10, wherein the first concave section is a space closed by the first convex section of the supporting member.

15. The push button device according to claim 11, wherein the first concave section is a space closed by the first convex section of the supporting member.

16. The push button device according to claim 12, wherein the first concave section is a space closed by the first convex section of the supporting member.

17. The push button device according to claim 1, wherein the supporting member is a case.

18. The push button device according to claim 9, wherein the supporting member is a case.

19. A timepiece comprising the push button device according to claim 1.

20. A timepiece comprising the push button device according to claim 9.

* * * * *